US009465327B1

(12) United States Patent
Takahashi et al.

(10) Patent No.: US 9,465,327 B1
(45) Date of Patent: Oct. 11, 2016

(54) TRANSFER MECHANISM AND IMAGE FORMING APPARATUS

(71) Applicant: FUJI XEROX CO., LTD., Tokyo (JP)

(72) Inventors: Akira Takahashi, Kanagawa (JP); Kazuyoshi Hagiwara, Kanagawa (JP); Yusuke Sakai, Kanagawa (JP); Mihoko Tanaka, Kanagawa (JP); Arichika Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/997,021

(22) Filed: Jan. 15, 2016

(30) Foreign Application Priority Data

Aug. 10, 2015 (JP) ..... 2015-158118

(51) Int. Cl.
*G03G 15/20* (2006.01)
*G03G 15/16* (2006.01)
*G03G 15/00* (2006.01)

(52) U.S. Cl.
CPC ..... *G03G 15/1615* (2013.01); *G03G 15/757* (2013.01)

(58) Field of Classification Search
CPC ..... G03G 15/1685; G03G 15/757
USPC ..... 399/167, 313
See application file for complete search history.

(56) References Cited

U.S. PATENT DOCUMENTS

2007/0231002 A1* 10/2007 Kouzu ..... G03G 15/167 399/121
2010/0303517 A1* 12/2010 Okamoto ..... G03G 15/167 399/313

FOREIGN PATENT DOCUMENTS

JP 2000-352922 A 12/2000
JP 2006-317632 A 11/2006

* cited by examiner

*Primary Examiner* — Hoang Ngo
(74) *Attorney, Agent, or Firm* — Oliff PLC

(57) ABSTRACT

Provided is a transfer mechanism including a rotor that configures a transfer section which transfers an image including a flat pigment to a recording medium, a second gear that engages with a first gear provided in a support, a to-be-supported object that is provided with the rotor and the second gear, is supported by the support through a shaft portion of the rotor, and is allowed to move around the shaft portion in a direction in which engagement of the second gear with the first gear becomes weaker, and a member that presses or pulls the to-be-supported object in a direction in which the engagement becomes stronger.

8 Claims, 12 Drawing Sheets

TRANSFER MECHANISM AND IMAGE FORMING APPARATUS

CROSS-REFERENCE TO RELATED APPLICATIONS

This application is based on and claims priority under 35 USC 119 from Japanese Patent Application No. 2015-158118 filed Aug. 10, 2015.

BACKGROUND

Technical Field

The present invention relates to a transfer mechanism and an image forming apparatus.

SUMMARY

According to an aspect of the invention, there is provided a transfer mechanism including:

a rotor that configures a transfer section which transfers an image including a flat pigment to a recording medium;

a second gear that engages with a first gear provided in a support;

a to-be-supported object that is provided with the rotor and the second gear, is supported by the support through a shaft portion of the rotor, and is allowed to move around the shaft portion in a direction in which engagement of the second gear with the first gear becomes weaker; and a member that presses or pulls the to-be-supported object in a direction in which the engagement becomes stronger.

BRIEF DESCRIPTION OF THE DRAWINGS

Exemplary embodiments of the present invention will be described in detail based on the following figures, wherein.

DETAILED DESCRIPTION

Hereinafter, an example of an exemplary embodiment according to the present invention will be described with reference to the accompanying drawings. Meanwhile, an arrow H illustrated in FIG. 1 indicates a vertical direction, and an arrow W indicates a horizontal direction and an apparatus width direction.

Image Forming Apparatus 10

Figure 1:
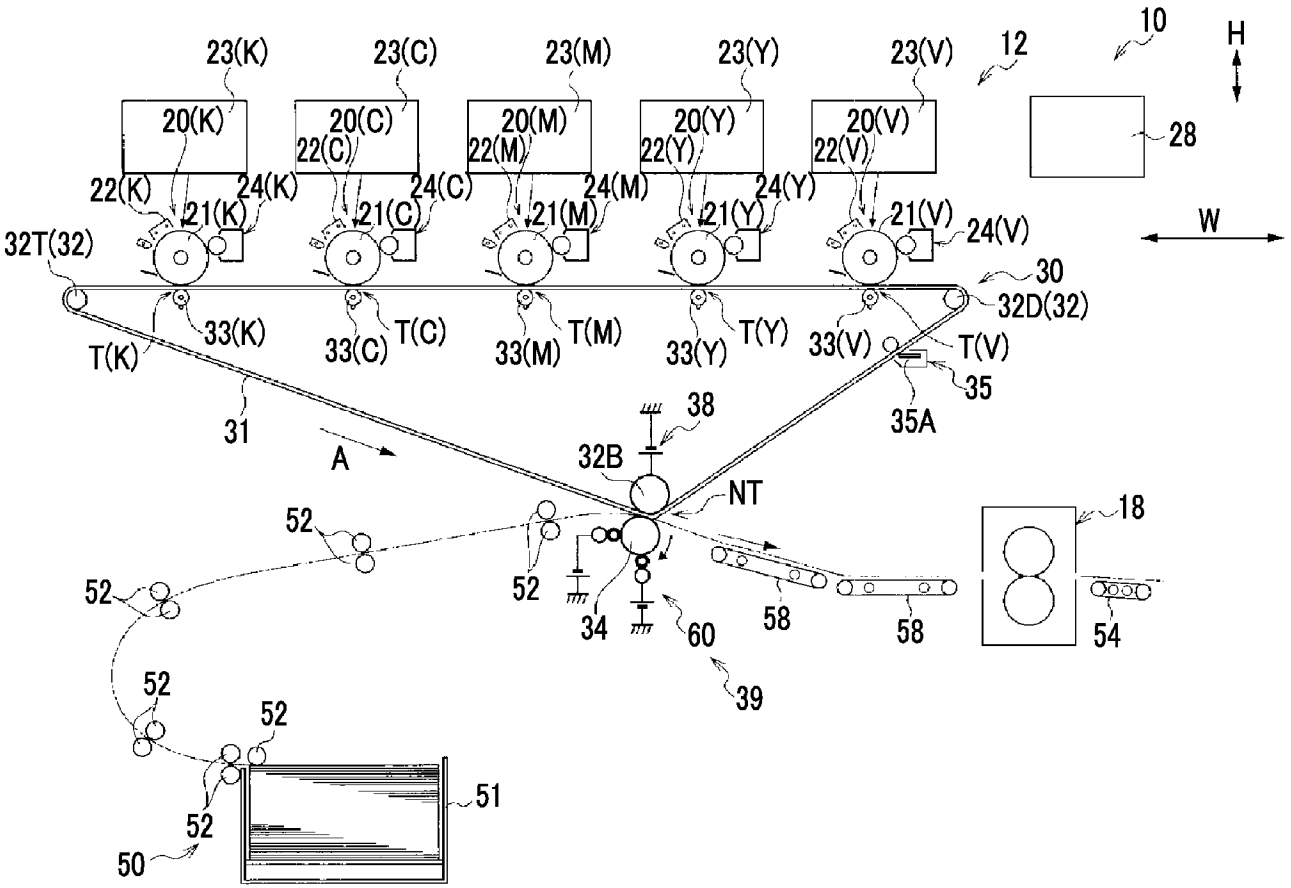
FIG. 1 is a schematic diagram illustrating a configuration of an image forming apparatus according to the present exemplary embodiment.

FIG. 1 is a schematic diagram illustrating a configuration when an image forming apparatus 10 is seen from the front side. As shown in the drawing, the image forming apparatus 10 includes an image forming section 12 (an example of a forming section) which forms an image on a recording medium P such as paper by an electrophotographic process, a transport device 50 that transports the recording medium P, and a control section 28 that controls the operation of each section of the image forming apparatus 10. Hereinafter, specific configurations of the transport device 50 and the image forming section 12 will be described.

Transport Device 50

As illustrated in FIG. 1, the transport device 50 includes a container 51 that accommodates the recording medium P, and plural transport rollers 52 that transport the recording medium P to a secondary transfer position NT to be described later from the container 51. Further, the transport device 50 includes plural transport belts 58 that transport the recording medium P from the secondary transfer position NT to a fixing device 18 to be described later, and a transport belt 54 that transports the recording medium P toward a discharge section (not shown) of the recording medium P from the fixing device 18.

Image Forming Section 12

As illustrated in FIG. 1, the image forming section 12 includes a toner image forming section 20 that forms a toner image, a transfer device 30 that transfers the toner image formed by the toner image forming section 20 to the recording medium P, and the fixing device 18 that heats and presses the toner image transferred to the recording medium P to thereby fix the toner image onto the recording medium P. Hereinafter, specific configurations of the toner image forming section 20 and the transfer device 30 will be described.

The plural toner image forming sections 20 are provided so as to form a toner image for each color. In the exemplary embodiment, the toner image forming sections 20 of a total of five colors of yellow (Y), magenta (M), cyan (C), black (K), and silver (V) are provided. The toner image forming sections 20 of the respective colors are disposed toward a downstream side of a transport direction of a transfer belt 31 to be described later from an upstream side thereof in the order of silver (V), yellow (Y), magenta (M), cyan (C), and black (K).

The signs of (V), (Y), (M), (C), and (K) illustrated in FIG. 1 indicate components corresponding to the respective colors mentioned above. Meanwhile, in the description of the specification, (V), (Y), (M), (C), and (K) may be described as V, Y, M, C, and K without their brackets. Hereinafter, yellow (Y), magenta (M), cyan (C), and black (K), except for silver (V), are collectively referred to as a "color".

Toner Image Forming Section 20

Figure 2:
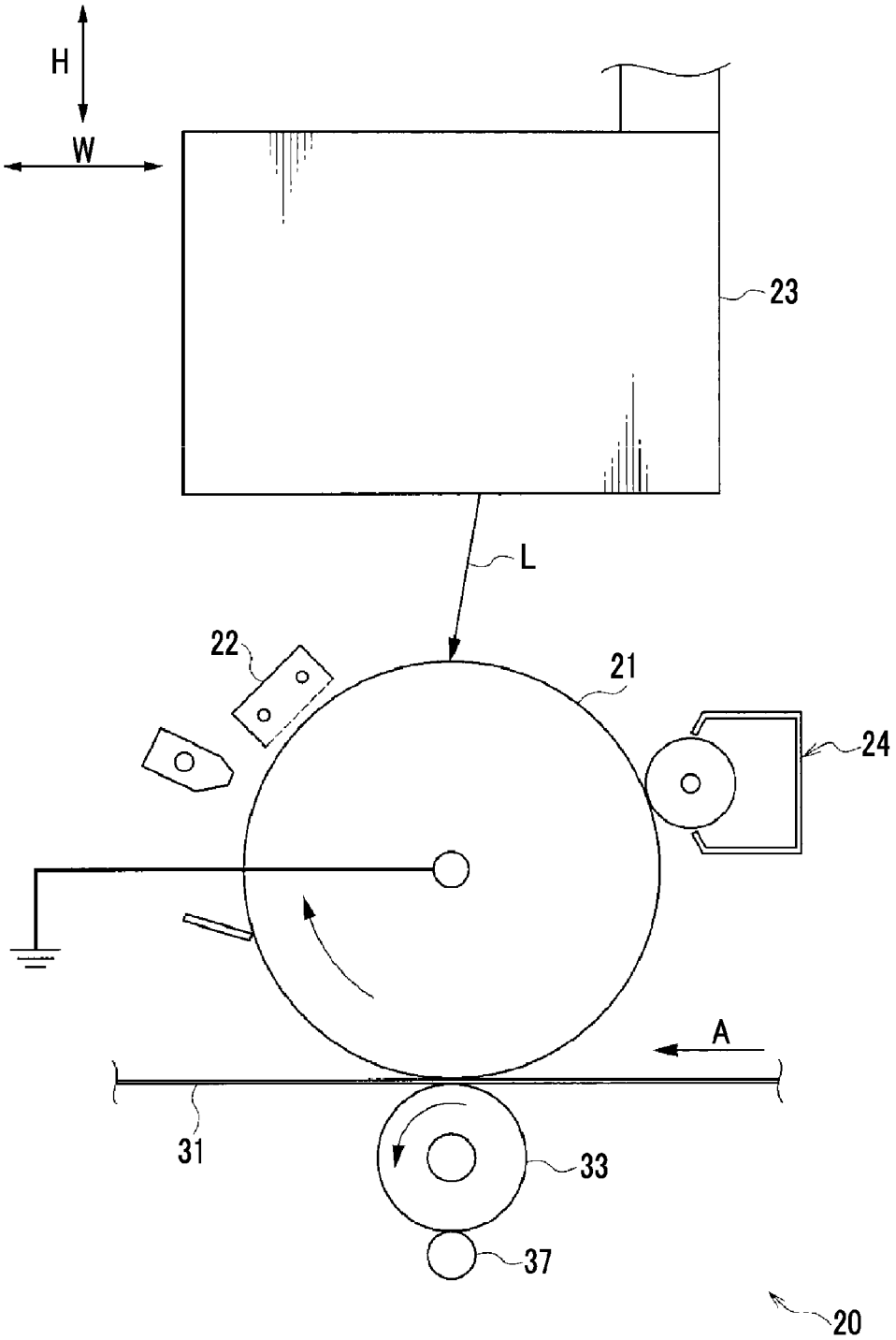
FIG. 2 is a schematic diagram illustrating a configuration of a toner image forming section according to the present exemplary embodiment.

The toner image forming sections 20 of the respective colors are basically configured in the same manner except for a toner to be used. Specifically, as illustrated in FIG. 2, each of the toner image forming sections 20 of the respective colors includes a photoconductor drum 21 which is rotated clockwise in FIG. 2, and a charger 22 that charges the photoconductor drum 21. Further, each of the toner image forming sections 20 of the respective colors includes an exposing device 23 that forms an electrostatic latent image on the photoconductor drum 21 by exposing the photoconductor drum 21 charged by the charger 22, and a developing device 24 that forms a toner image by developing the electrostatic latent image formed on the photoconductor drum 21 by the exposing device 23.

Specifically, an exposing device 36 irradiates the photoconductor drum 21 with exposure light modulated in accordance with image data acquired by the control section 28 to thereby form an electrostatic latent image on the photoconductor drum 21. The electrostatic latent image is developed by the developing device 24, and thus a toner image based on the image data is formed. The image data acquired by the control section 28 includes, for example, image data which is generated by an external device (not shown) and is acquired from the external device.

Figure 9:
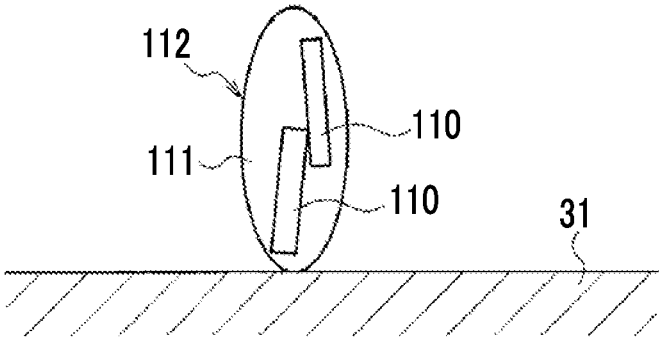
FIG. 9 is a schematic diagram illustrating a state where a toner containing a flat pigment stands up on a transfer belt.

The toner image forming section 20V forms a toner image using a silver toner 112 (See FIG. 9). Meanwhile, hereinafter, for convenience of description, a toner image formed of a silver toner is referred to as a "silver image".

As illustrated in FIG. 9, the silver toner 112 used by the toner image forming section 20V is configured to include a pigment 110 as an example of a flat pigment, and a binder resin 111. The pigment 110 is formed of a metal such as aluminum. When the pigment 110 is placed on a plane and is seen from the side, the pigment 110 has a shape in which a dimension in a right-left direction in the drawing is larger than a dimension in an up-down direction in the drawing as illustrated in FIG. 3B. In the pigment 110, a dimension ratio of the dimension in the right-left direction to the dimension in the up-down direction is larger than the dimension ratio in a pigment of a color toner to be described later. In addition, the silver toner has a particle size larger than that of the color toner to be described later. Specifically, a volume average particle size of the color toner is set to, for example, approximately 4 μm to 6 μm, while a volume average particle size of the silver toner is set to, for example, approximately 10 μm.

Figure 3A:
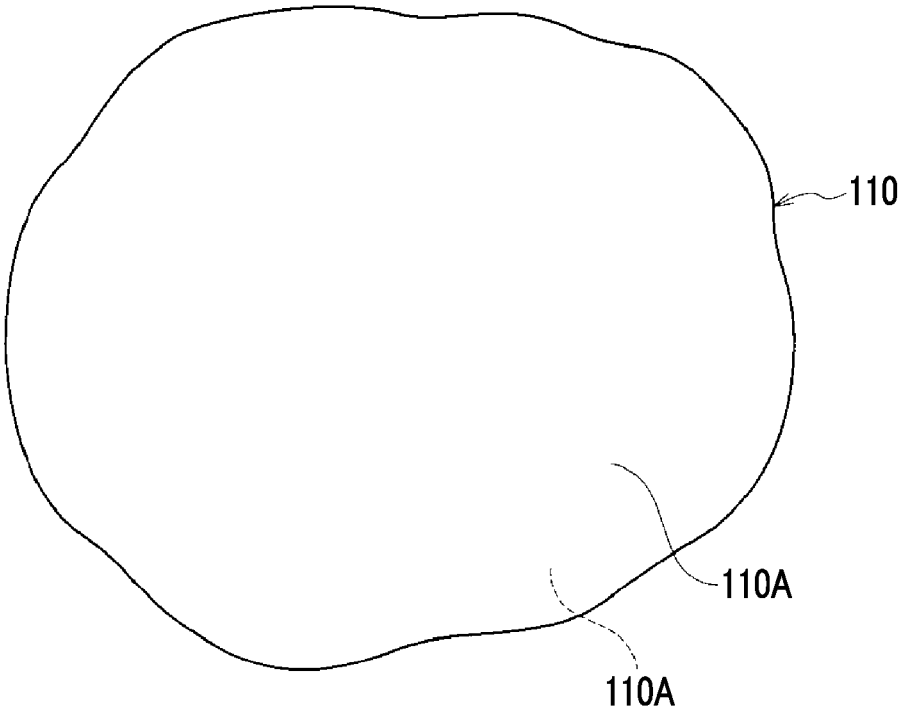
FIGS. 3A and 3B are a plan view and a side view of a flat pigment according to the present exemplary embodiment, respectively.
Figure 3B:
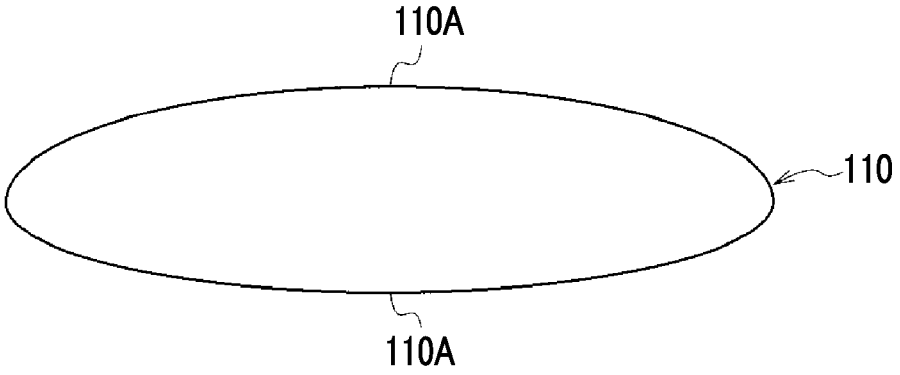

In addition, when the pigment 110 illustrated in FIG. 3B is seen from above in the drawing, the pigment 110 has a shape expanded with respect to a shape seen from the side, as illustrated in FIG. 3A. The pigment 110 has a pair of reflective surfaces 110A facing upward and downward in a state where the pigment 110 is placed on a plane (see FIG. 3B). In this manner, the pigment 110 has a flat shape.

On the other hand, the toner image forming sections 20Y, 20M, 20C, 20K (hereinafter, referred to as 20Y to 20K) form a toner image using a color toner. The color toner does not contain a flat pigment, and is configured to include a pigment (for example, an organic pigment or an inorganic pigment) except for a flat pigment, and a binder resin. The pigment has a shape close to a spherical shape, compared to the pigment 110. Meanwhile, hereinafter, for convenience of description, a toner image formed of a color toner is referred to as a "color image".

Transfer Device 30

As illustrated in FIG. 1, the transfer device 30 primarily transfers toner images on the photoconductor drums of the respective colors to the transfer belt 31 (intermediate transfer body) so as to be superimposed thereon, and secondarily transfers the superimposed toner images to the recording medium P at the secondary transfer position NT. Specifically, the transfer device 30 includes the transfer belt 31 (intermediate transfer body), a primary transfer roller 33, and a secondary transfer mechanism 39 (an example of a transfer mechanism) which includes a secondary transfer roller 34 (an example of a rotor). Hereinafter, specific configurations of the transfer belt 31, the primary transfer roller 33, and the secondary transfer mechanism 39 will be described.

Transfer Belt 31

As illustrated in FIG. 1, the transfer belt 31 has an endless shape and has a posture determined by being wound around plural rollers 32. In the exemplary embodiment, the transfer belt 31 has a posture having an inverted obtuse triangular shape which is long in an apparatus width direction when seen in a front view. Among the plural rollers 32, a roller 32D illustrated in FIG. 1 functions as a driving roller that circulates the transfer belt 31 in a direction of an arrow A by motive power of a motor not shown in the drawing. The transfer belt 31 circulates in the direction of the arrow A to thereby transport a toner image of each color, which is primarily transferred, to the secondary transfer position NT from the primary transfer position T of each color.

In addition, among the plural rollers 32, a roller 32T illustrated in FIG. 1 functions as a tension applying roller that applies tension to the transfer belt 31. Among the plural rollers 32, a roller 32B illustrated in FIG. 1 functions as an opposite roller 32B opposite to the secondary transfer roller 34. An apex on a lower end side forming an obtuse angle of the transfer belt 31 having an inverted obtuse triangular posture, as described above, is wound around the opposite roller 32B. The transfer belt 31 is in contact with the photoconductor drums 21 of the respective colors from below at an upper side portion extending in the apparatus width direction with the above-mentioned posture.

Meanwhile, a cleaning device 35 that cleans the outer circumferential surface of the transfer belt 31 is provided on the outer circumferential surface side of the transfer belt 31. As illustrated in FIG. 1, the cleaning device 35 is disposed on a downstream side of the secondary transfer position NT and on an upstream side of the primary transfer position T (V) in a circulation direction of the transfer belt 31. The cleaning device 35 includes a blade 35A that scrapes off toner remaining on the surface of the transfer belt 31 from the surface of the transfer belt 31.

Primary Transfer Roller 33

The primary transfer roller 33 is a roller that transfers a toner image of each of the photoconductor drums 21 to the transfer belt 31, and is disposed on the inner side of the transfer belt 31 as illustrated in FIG. 1. Each of the primary transfer rollers 33 is disposed facing the photoconductor drum of the corresponding color with the transfer belt 31 interposed therebetween. In addition, a primary transfer voltage (primary transfer current) having a polarity opposite to that of a toner is applied to each of the primary transfer rollers 33 by a power feed section 37 (see FIG. 2). Thereby, a transfer electric field is formed between the photoconductor drum 21 of the toner image forming section 20 and the primary transfer roller 33, and thus an electrostatic force acts on the toner image formed on the photoconductor drum 21, thereby transferring the toner image to the transfer belt 31 at the primary transfer position T.

Secondary Transfer Mechanism 39

Figure 4:
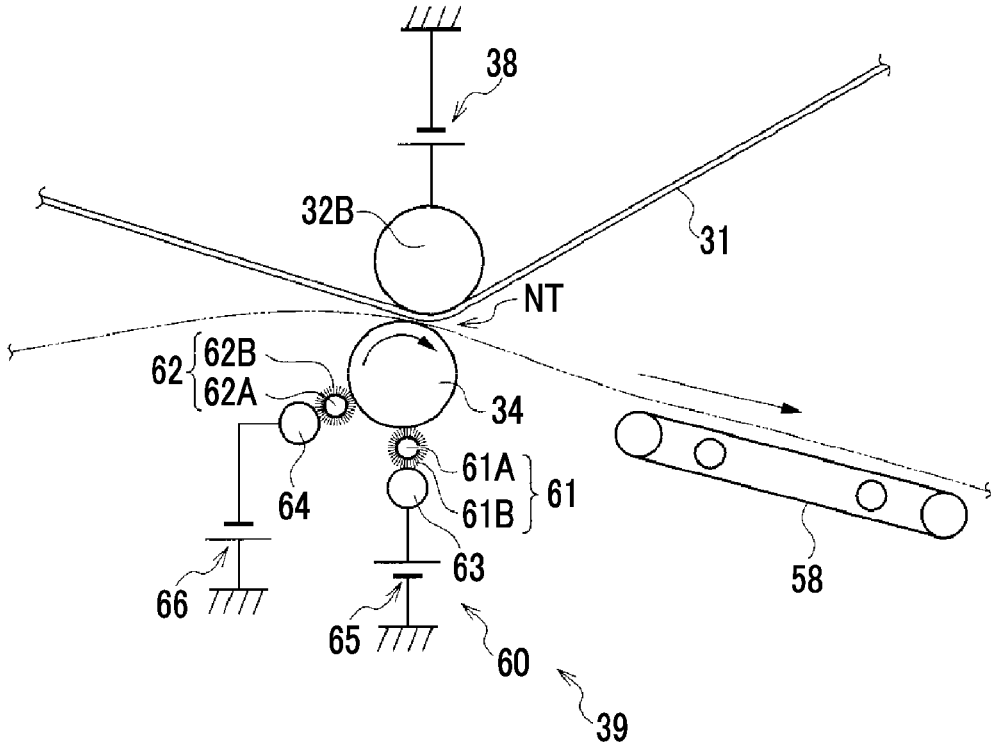
FIG. 4 is a schematic diagram illustrating a portion of a configuration of a secondary transfer mechanism according to the present exemplary embodiment.
Figure 5:
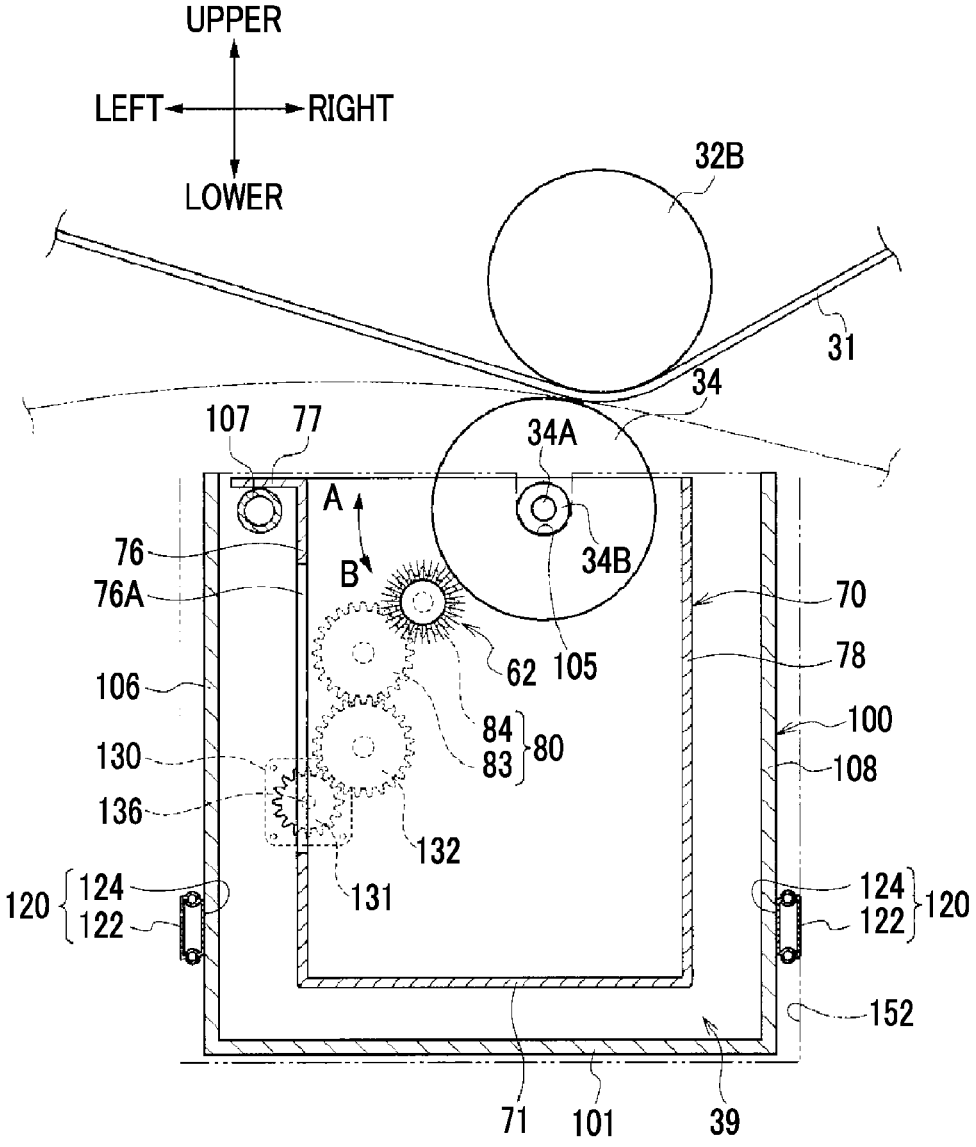
FIG. 5 is a schematic diagram illustrating a portion of a configuration of a secondary transfer mechanism according to the present exemplary embodiment.
Figure 6:
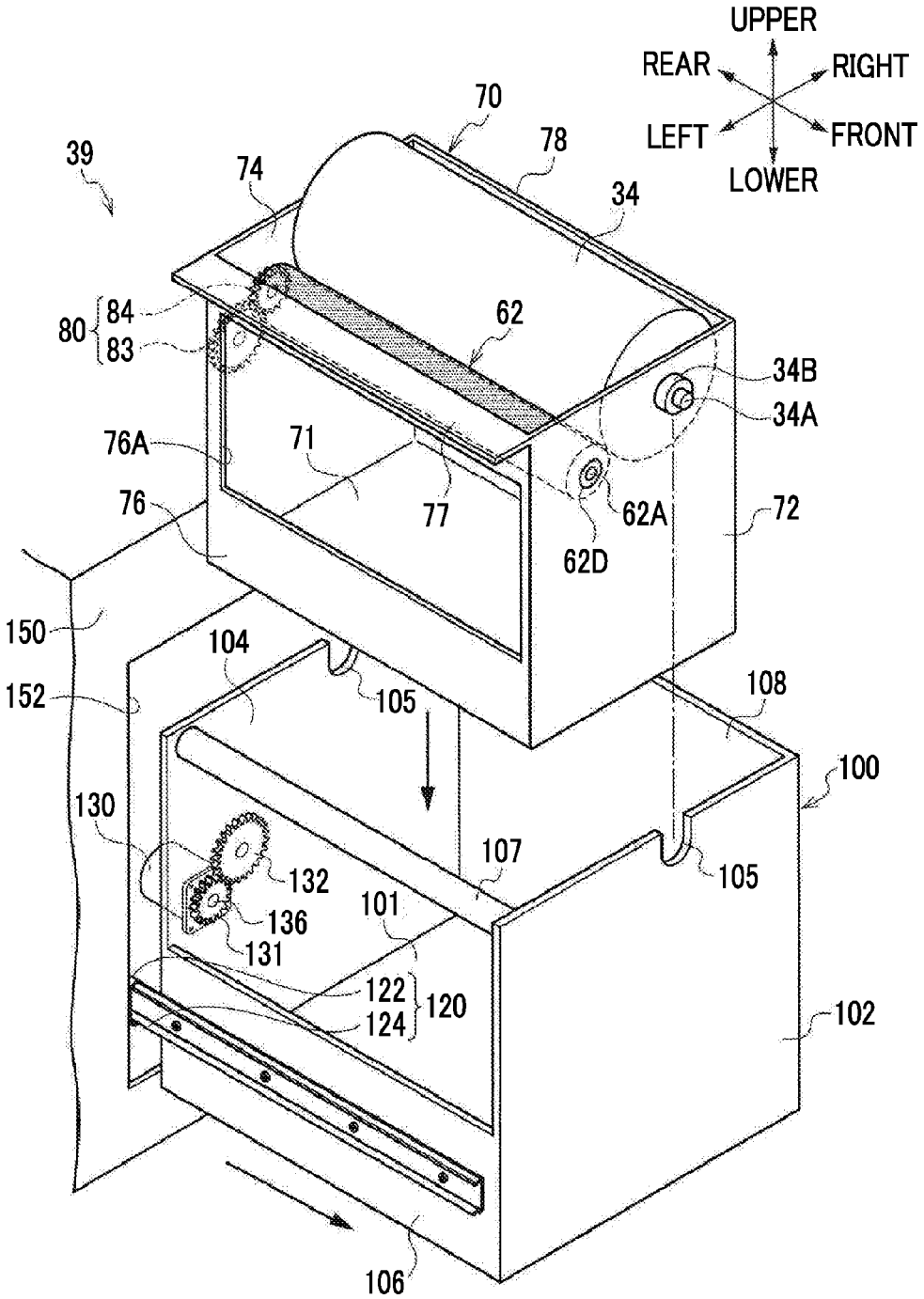
FIG. 6 is a perspective view illustrating a portion of a configuration of a secondary transfer mechanism according to the present exemplary embodiment.
Figure 7:
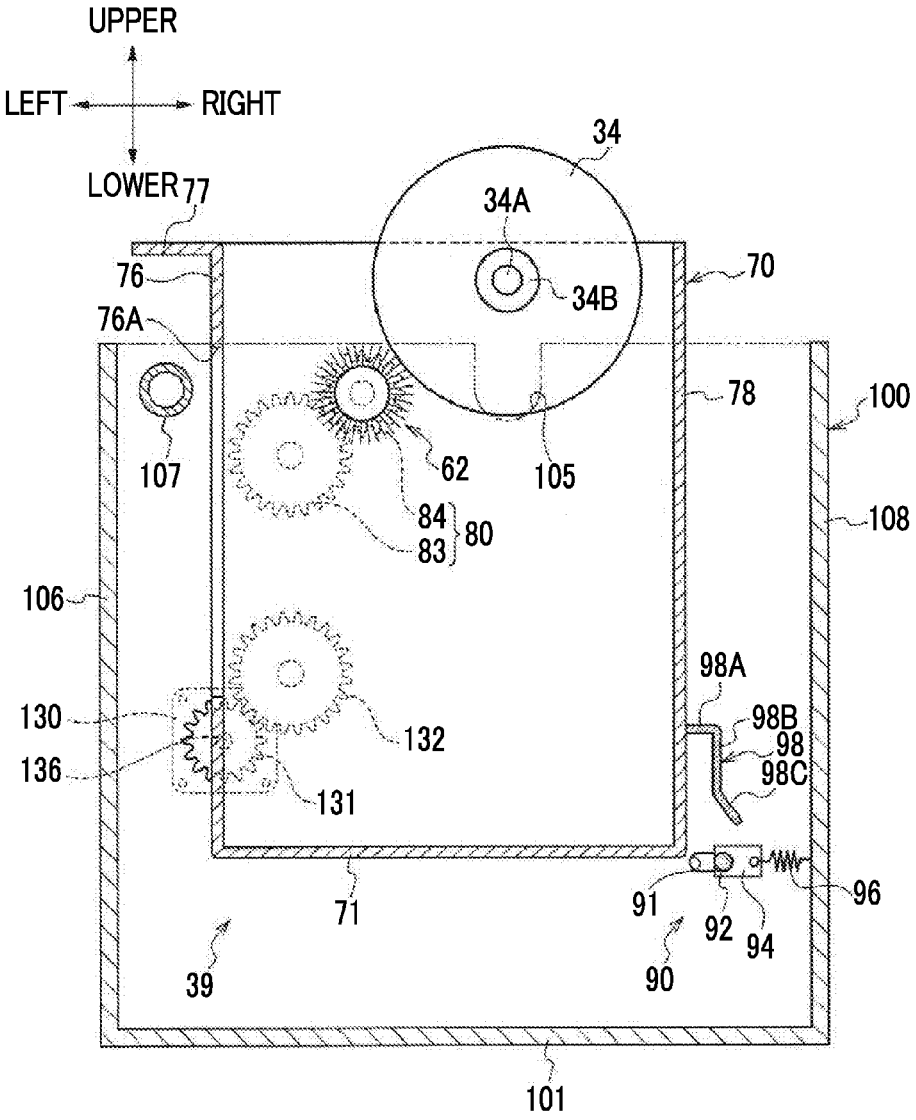
FIG. 7 is a schematic diagram illustrating a configuration of a tension mechanism according to the present exemplary embodiment.
Figure 8:
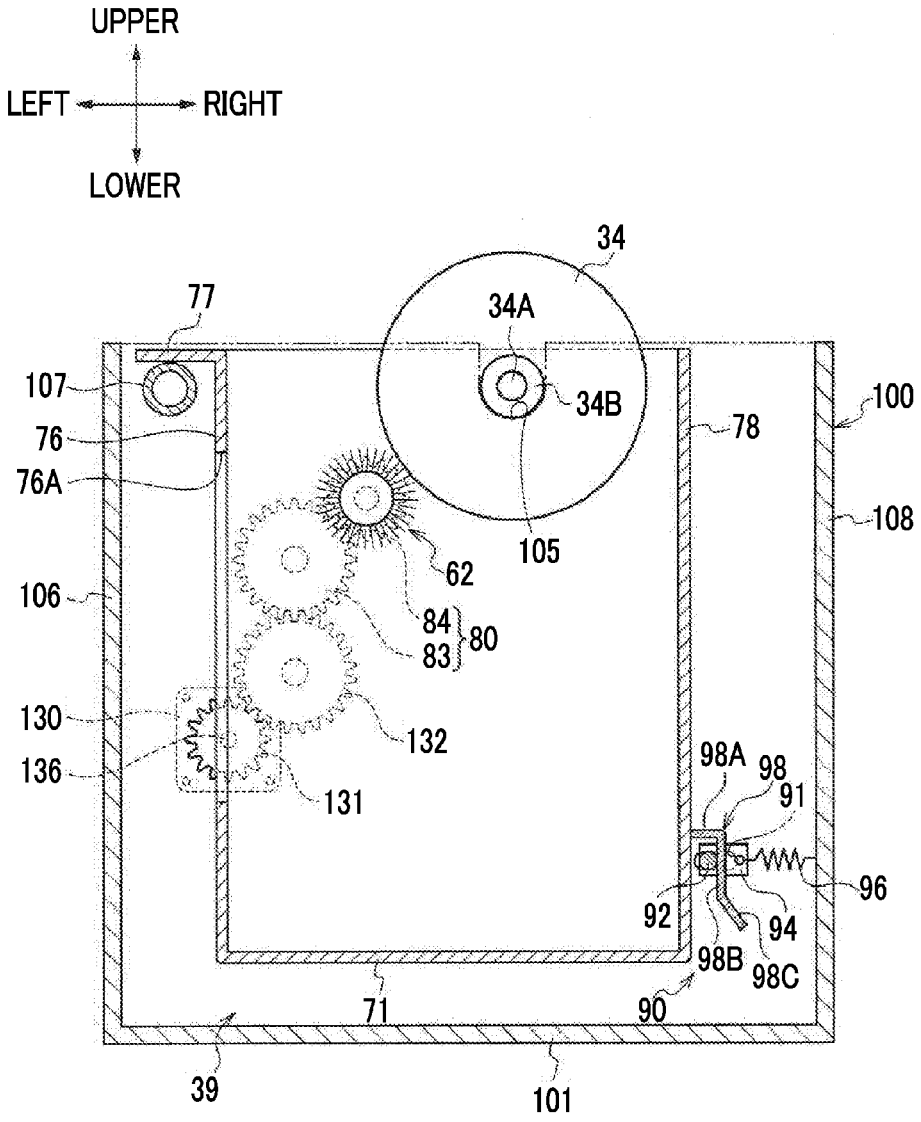
FIG. 8 is a schematic diagram illustrating a configuration of a tension mechanism according to the present exemplary embodiment.

As illustrated in FIG. 4, the secondary transfer mechanism 39 includes the above-mentioned secondary transfer roller 34 (an example of a rotor) constituting a secondary transfer section (an example of a transfer section), and a cleaning section 60 that cleans the outer circumferential surface of the secondary transfer roller 34. In addition, as illustrated in FIGS. 5 and 6, the secondary transfer mechanism 39 includes a transmission section 80 that transmits a driving force to a second cleaning brush 62 to be described later of the cleaning section 60 (see FIG. 4), a frame 70 (an example of a to-be-supported object) provided with the secondary transfer roller 34, the cleaning section 60, and the transmission section 80. Further, as illustrated in FIGS. 7 and 8, the secondary transfer mechanism 39 includes a tension mechanism 90 that pulls the frame 70.

Hereinafter, specific configurations of the secondary transfer roller 34, the cleaning section 60, the transmission section 80, the frame 70, and the tension mechanism 90 will be described. Meanwhile, forward, backward, upward, downward, leftward (left side), and rightward (right side) that are used in the following description respectively correspond to arrow directions indicated by "front", "rear", "upper", "lower", "left", and "right" in the drawing. These directions are directions determined for convenience of description, and thus the configuration of the apparatus configuration is not limited to these directions. In addition, the wording "up-down direction" and the wording "right-left direction" as used herein correspond to the vertical direction illustrated in FIG. 1 and the horizontal direction illustrated in FIG. 1, respectively.

Secondary Transfer Roller 34

The secondary transfer roller 34 (an example of a rotor) is a roller that transfers the toner images superimposed on the transfer belt 31 to the recording medium P. As illustrated in FIG. 4, the secondary transfer roller 34 is disposed facing the opposite roller 32B with the transfer belt 31 interposed therebetween, and the secondary transfer roller 34 and the transfer belt 31 are in contact with each other with a load determined in advance. In this manner, a position between the secondary transfer roller 34 and the transfer belt 31 serves as the secondary transfer position NT. The recording medium P is configured to be timely supplied to the secondary transfer position NT from the container 51. The secondary transfer roller 34 is rotated clockwise in FIG. 1.

In addition, in the secondary transfer roller 34, a voltage having a negative polarity is applied to the opposite roller 32B by a power feed section 38, and thus a potential difference occurs between the opposite roller 32B and the secondary transfer roller 34. That is, the voltage having a negative polarity is applied to the opposite roller 32B, and thus a secondary transfer voltage (voltage having a positive polarity) having a polarity opposite to that of a toner is indirectly applied to the secondary transfer roller 34 constituting a counter electrode of the opposite roller 32B. Thereby, a transfer electric field is formed between the opposite roller 32B and the secondary transfer roller 34, and thus an electrostatic force acts on the toner image of the transfer belt 31, thereby transferring the toner image from the transfer belt 31 to the recording medium P passing through the secondary transfer position NT.

Cleaning Section 60

As illustrated in FIG. 4, the cleaning section 60 includes a first cleaning brush 61 and the second cleaning brush 62 as removing members that adsorb and remove the toner (silver toner and color toner) of the secondary transfer roller 34. The first cleaning brush 61 and the second cleaning brush 62 include shaft portions 61A and 62A and brush portions 61B and 62B provided over the entire outer circumferences of the shaft portions 61A and 62A, respectively. The first cleaning brush 61 and the second cleaning brush 62 are configured to be rotated by the rotation of the shaft portions 61A and 62A. As an example, the first cleaning brush 61 and the second cleaning brush 62 are configured to be rotated in the same direction (clockwise direction in FIG. 4) as the circulation direction of the secondary transfer roller 34. Meanwhile, the first cleaning brush 61 and the second cleaning brush 62 may be configured to be rotated in a direction (counterclockwise direction in FIG. 4) which is opposite to the circulation direction of the secondary transfer roller 34. In addition, when the first cleaning brush 61 and the second cleaning brush 62 are rotated in the direction opposite to the circulation direction of the secondary transfer roller 34, for example, the cleaning brushes are configured to be rotated with a peripheral speed difference with respect to the peripheral speed of the secondary transfer roller 34.

In addition, the cleaning section 60 includes a first metal roller 63 that comes into contact with the brush portion 61B of the first cleaning brush 61, and a second metal roller 64 that comes into contact with the brush portion 62B of the second cleaning brush 62.

Further, the cleaning section 60 includes a first power feed section 65 that applies a cleaning voltage having a positive polarity to the first metal roller 63, and a second power feed section 66 that applies a cleaning voltage having a negative polarity to the second metal roller 64.

The first power feed section 65 applies a cleaning voltage having a positive polarity to the first metal roller 63, and thus a cleaning current flows to the secondary transfer roller 34, the first cleaning brush 61, and the first metal roller 63, as a direct current. Thereby, the first cleaning brush 61 is set to have a positive polarity with respect to the secondary transfer roller 34, and the first metal roller 63 is set to have a positive polarity with respect to the first cleaning brush 61.

With such a configuration, among toners on the secondary transfer roller 34, a toner charged to a negative polarity is electrostatically adsorbed into the first cleaning brush 61 and moved, is moved to the first metal roller 63, and is then removed from the secondary transfer roller 34.

In addition, the second power feed section 66 applies a cleaning voltage having a negative polarity to the second metal roller 64, and thus a cleaning current flows to the secondary transfer roller 34, the second cleaning brush 62, and the second metal roller 64, as a direct current. Thereby, the second cleaning brush 62 is set to have a negative polarity with respect to the secondary transfer roller 34, and the second metal roller 64 is set to have a negative polarity with respect to the second cleaning brush 62.

Thereby, among toners on the secondary transfer roller 34, a toner charged to a positive polarity is electrostatically adsorbed into the second cleaning brush 62 and moved, is moved to the second metal roller 64, and is then removed from the secondary transfer roller 34.

Meanwhile, the toners moved to the first metal roller 63 and the second metal roller 64 are removed from the first metal roller 63 and the second metal roller 64 by a removing member (not shown) such as a blade. The toners removed from the first metal roller 63 and the second metal roller 64 are accommodated (recovered) in an accommodation container (not shown) provided in the frame 70.

Frame 70

As illustrated in FIGS. 5 and 6, the frame 70 is formed to have a box shape in which an upper portion is opened. Specifically, the frame 70 includes a bottom plate 71, a front plate 72, a rear plate 74, a left side plate 76, and a right side plate 78. The front plate 72 and the rear plate 74 rotatably support the secondary transfer roller 34 and the second cleaning brush 62 through bearing portions 34B and 62D provided at both ends of a shaft portion 34A of the secondary transfer roller 34 and the shaft portion 62A of the second cleaning brush 62. Specifically, the secondary transfer roller 34 is supported by the upper portions of the front plate 72 and the rear plate 74.

Although not shown in the drawing, the first cleaning brush 61 is also rotatably supported by the front plate 72 and the rear plate 74. Further, although not shown in the drawing, both ends of the first metal roller 63 and both ends of the second metal roller 64 in the axial direction are fixed to the front plate 72 and the rear plate 74.

An opening 76A is formed in the left side plate 76. In addition, a projecting plate 77 projecting to the side (left side in FIG. 5) is formed at an upper end of the left side plate 76. The projecting plate 77 has a length along the secondary transfer roller 34.

The frame 70 is configured to be able to accommodate and take out a draw-out body 100 (an example of a support) to be described later. That is, the frame 70 is configured to be attached to and detached from the draw-out body 100 to be described later. A specific configuration of the draw-out body 100 will be described later.

Transmission Section 80

As illustrated in FIGS. 5 and 6, the transmission section 80 includes a gear 83 (an example of a second gear) and a gear 84 engaging with the gear 83 on the right side of the gear 83. The gear 83 and the gear 84 are disposed on the back side of the rear plate 74 of the frame 70, and are rotatably supported by the rear plate 74 of the frame 70. Specifically, the gear 84 is fixed to an end on the rear side in the shaft portion 62A of the second cleaning brush 62.

Draw-Out Body 100

As illustrated in FIGS. 5 and 6, the draw-out body 100 is formed to have a box shape in which an upper portion is opened. Specifically, the draw-out body 100 includes a bottom plate 101, a front plate 102, a rear plate 104, a left side plate 106, and a right side plate 108.

Each of the left side plate 106 and the right side plate 108 is provided with a rail member 120 capable of drawing out the draw-out body 100 with respect to an image forming apparatus main body 150. The rail member 120 includes an outer rail 122 and an inner rail 124 that extend along a front-back direction. The outer rails 122 are fixed to the image forming apparatus main body 150. The inner rails 124 are fixed to the left side plate 106 and the right side plate 108, respectively.

The draw-out body 100 is pulled forward by an operator, and thus the inner rails 124 slide forward with respect to the respective outer rails 122, thereby drawing out the draw-out body 100 forward from an opening 152 of the image forming apparatus main body 150. In addition, the drawn-out draw-out body 100 is pressed backward by the operator, and thus the inner rails 124 slide backward with respect to the respective outer rails 122, thereby accommodating the draw-out body 100 in the image forming apparatus main body 150.

In addition, a driving motor 130 as a driving section is mounted on the back side of the rear plate 104. A driving shaft 136 of the driving motor 130 protrudes to the front side of the rear plate 104. A driving gear 131 is fixed to the driving shaft 136 on the front side of the rear plate 104. A gear 132 (an example of a first gear) engaging with the driving gear 131 is rotatably supported by the rear plate 104 on the obliquely upper right side of the driving gear 131 and on the front side of the rear plate 104.

In addition, a concave portion 105 (notch) having a U shape is formed in an edge portion at an upper end of the front plate 102 and an edge portion at an upper end of the rear plate 104. When the frame 70 is accommodated (mounted) in the draw-out body 100 from above the draw-out body 100, the bearing portions 34B of the secondary transfer roller 34 provided in the frame 70 are inserted into the concave portion 105. Thereby, in a state where the frame 70 is accommodated in the draw-out body 100, the frame 70 is supported by the edge portion of the concave portion 105 through the shaft portion 34A of the secondary transfer roller 34. The frame 70 is supported through the shaft portion 34A of the secondary transfer roller 34, and thus is supported by the draw-out body 100 so as to be rotatable (movable) around the shaft portion 34A of the secondary transfer roller 34.

In addition, a cylindrical member 107 having one end and the other end in the axial direction respectively fixed to the front plate 102 and the rear plate 104 is disposed between an upper left portion in the front plate 102 and an upper left portion in the rear plate 104. When the frame 70 is accommodated in the draw-out body 100 from above the draw-out body 100, the projecting plate 77 of the frame 70 is placed on the cylindrical member 107. Thereby, the rotation (movement) of the frame 70 about the shaft portion 34A of the secondary transfer roller 34 is restricted.

The state where the projecting plate 77 is placed on (is in contact with) the cylindrical member 107 is maintained by the weight of the frame 70. The gear 83 disposed in the frame 70 and the gear 132 disposed in the draw-out body 100 engage with each other at an engagement position (reference position) which is determined in advance at a position where the projecting plate 77 is placed on the cylindrical member 107.

In the present exemplary embodiment, the frame 70 is not restricted (fixed) in a state of being accommodated in the draw-out body 100, and thus the projecting plate 77 is allowed to float from the cylindrical member 107. That is, the frame 70 is allowed to move around the shaft portion 34A of the secondary transfer roller 34 in a direction (direction of the arrow A in FIG. 5) in which the engagement of the gear 83 with the gear 132 becomes weaker.

Tension Mechanism 90

As illustrated in FIGS. 7 and 8, the tension mechanism 90 includes a shaft body 92, a fixed plate 94, a pulling spring (an example of a member), and a receiving plate 98. Meanwhile, in FIGS. 5 and 6, the tension mechanism 90 is not shown.

The shaft body 92 has a length in the front-back direction, and is supported by the draw-out body 100 so as to be movable in the right-left direction. Specifically, as an example, a front end (one end in the longitudinal direction) and a rear end (the other end in the axial direction) of the shaft body 92 are respectively inserted into a long hole 91 formed in the front plate 102 and the rear plate 104 along the right-left direction, and thus the shaft body 92 is supported by the draw-out body 100 so as to be movable in the right-left direction. More specifically, the shaft body 92 is supported by the draw-out body 100 so as to be movable in the right-left direction between a first position (position illustrated in FIG. 7) that comes into contact with a right edge of the long hole 91 and a second position that comes into contact with a left edge of the long hole 91.

As an example, a pair of fixed plates 94 is provided. As an example, the fixed plates 94 are respectively fixed to a rear surface side of the front plate 72 at the front end of the shaft body 92 and a front surface side of the rear plate 74 at the rear end of the shaft body 92.

Similarly to the fixed plate 94, as an example, a pair of pulling springs 96 are provided. One end (free end) of the pulling spring 96 is attached to the fixed plate 94, and the other end (fixed end) thereof is attached to the right side plate 108 of the draw-out body 100. Thereby, the pulling springs 96 pull the shaft body 92 to the right through the respective fixed plates 94 by an elastic force. Therefore, in a state where only an elastic force generated by the pulling springs 96 acts on the shaft body 92 (state where an opposing force against the elastic force does not act), the shaft body 92 is located at the first position (position illustrated in FIG. 7).

The receiving plate 98 is fixed to a lower portion of the right side plate 78 of the frame 70. The receiving plate 98 includes a projecting portion 98A that projects to the right side from the right side plate 78, a receiving portion 98B that extends downward from a right end of the projecting portion 98A, and a leading portion 98C that extends to the obliquely lower right side from a lower end of the receiving portion 98B.

The frame 70 is moved downward with respect to the draw-out body 100 so that the bearing portion 34B of the secondary transfer roller 34 is inserted into the concave portion 105 of the draw-out body 100 by an operator's operation of accommodating the frame 70 in the draw-out body 100, and thus the leading portion 98C comes into contact with the shaft body 92 from above. Thereby, the leading portion 98C leads the shaft body 92 to the left while pressing the shaft body. In a state where the frame 70 is accommodated in the draw-out body 100, the shaft body 92 is disposed between the receiving portion 98B and the right side plate 78, and the pulling springs 96 pull the receiving portion 98 to the right through the fixed plate 94 and the shaft body 92. Thereby, the frame 70 is pulled in a direction (direction of an arrow B in FIG. 5) in which the engagement of the gear 83 with the gear 132 becomes stronger, around the shaft portion 34A of the secondary transfer roller 34.

In this manner, in the tension mechanism 90, when the frame 70 is mounted to the draw-out body 100, the receiving plate 98 (member) provided in the frame 70 moves the free end of the pulling spring 96 by pressing the shaft body 92 (member) provided in the free end, and thus the pulling springs 96 are set to be in a state of pulling the frame 70. That is, in the tension mechanism 90, the pulling springs 96 are set to be in a state of pulling the frame 70 by the installing of the frame 70 in the draw-out body 100.

Meanwhile, in the present exemplary embodiment, a guide (guiding portion) for inserting the bearing portion 34B of the secondary transfer roller 34 into the concave portion 105 of the draw-out body 100 and a guide (guiding portion) for bringing the leading portion 98C into contact with the shaft body 92 from above may be provided. In addition, the shaft body 92 may be provided with a rotor such as a rotatable roller that comes into contact with the receiving plate 98.

Action According to the Present Exemplary Embodiment

In the image forming apparatus according to the present exemplary embodiment, when a silver image and a color image are formed on the recording medium P, the image forming units 20 of the respective colors, the transfer device 30, and the fixing device 40 are operated. Thereby, in the image forming unit 20 of each color, a toner image is formed. Specifically, in the image forming unit 20 of each color, a toner image is formed by the following image forming step (process).

That is, the photoconductor drums 21 of the respective colors are charged by the charger 22 while being rotated. In addition, the exposing devices 23 emit each exposure light L in accordance with image data to thereby expose the respective charged photoconductor drums 21. Then, an electrostatic latent image is formed on the surface of each of the photoconductor drums 21. The electrostatic latent image formed on each of the photoconductor drums 21 is developed by a developer supplied from the developing device 24. Thereby, toner images of yellow (Y), magenta (M), cyan (C), black (K), white (W), and silver (V) are formed on the photoconductor drums 21 of the respective colors.

The toner images of the respective colors formed on the photoconductor drums 21 of the respective colors are sequentially transferred to the transfer belt 31 which is circulating, in a transfer electric field formed between the photoconductor drums 21 of the respective colors and the primary transfer rollers 33 of the respective colors. Thereby, a toner image obtained by superimposing the toner images of the respective colors on each other is formed on the transfer belt 31. The toner image obtained by the superimposition is transported to the secondary transfer position NT by the circulation of the transfer belt 31.

The toner image superimposed on the transfer belt 31 is transferred to the recording medium P transported from the container 51, at the secondary transfer position NT. The toner image transferred to the recording medium P is fixed onto the recording medium P by the fixing device 40.

Here, the silver toner 112 transferred to the transfer belt 31 is polarized on the transfer belt 31 as illustrated in FIG. 9, and thus there is a tendency for the longitudinal direction of the silver toner 112 to be set to be in a state (standing state) along a direction perpendicular to the transfer belt 31. In addition, the injection of electric charge occurs by the application of a transfer voltage at each primary transfer position TV, and thus polarization is promoted, thereby increasing the amount of toner which is present in a standing state on the transfer belt 31.

In addition, for example, in a configuration (comparative example) in which the frame 70 is in a non-load state (state where a load through a spring or the like does not act) without including the tension mechanism 90, the frame 70 tends to be moved, and thus an engagement state between the gear 83 disposed in the frame 70 and the gear 132 disposed in the draw-out body 100 may become weaker. In particular, when the amount of toner removed by the cleaning section 60 and accommodated in the accommodation container (not shown) is small (at the initial stage of operation of the image forming apparatus 10), the frame 70 is lightweight, and thus the frame 70 tends to be moved and the engagement state of the gear 83 with the gear 132 tends to become weaker. When the engagement state of the gear 83 with the gear 132 becomes weaker, the gear 132 and the gear 83 are loosened, and the secondary transfer roller 34 may vibrate.

When the secondary transfer roller 34 vibrates at the time of transferring a silver image to the recording medium P from the transfer belt 31, the posture of the pigment 110 of the silver toner 112 in the transferred silver image changes depending on a vibration period. In particular, as described above, in a state where the silver toner 112 stands up on the transfer belt 31 (see FIG. 9), a contact area with the transfer belt 31 is smaller than in a case where the silver toner is in a laid-down state, and the adhesion of the silver toner 112 to the transfer belt 31 is low. Therefore, there is a tendency for the posture of the pigment 110 of the silver toner 112 to change.

Figure 10:
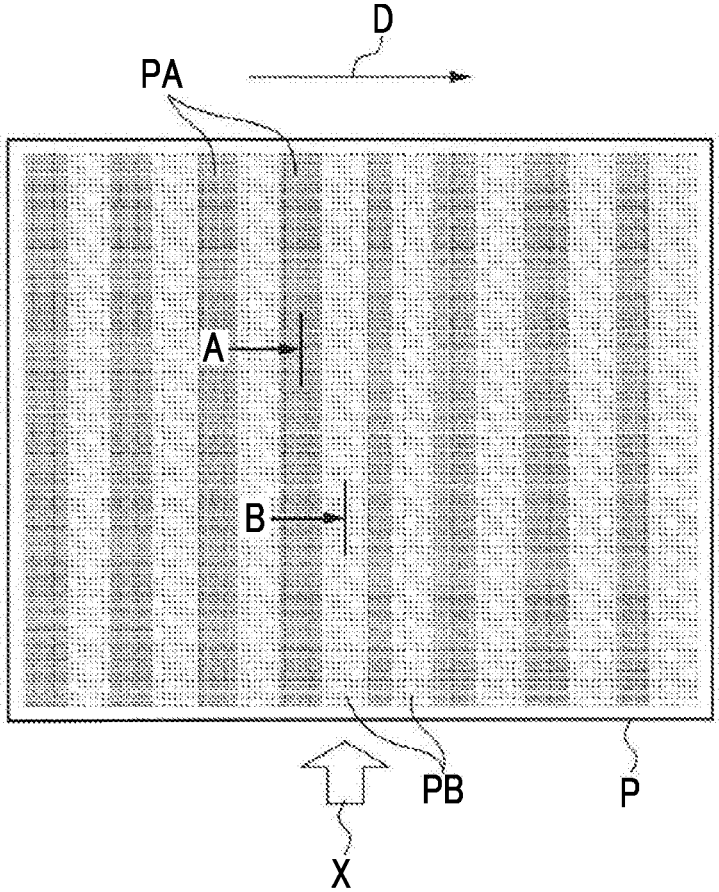
FIG. 10 is a diagram illustrating orientation irregularities (irregularities of a feeling of metallic luster) of a flat pigment in an image formed on a recording medium.

Periodic variations in the posture of the pigment 110 occur in the fixed silver image by the periodic change in the posture of the pigment 110. That is, in the fixed silver image, orientation irregularities of the pigment 110 as illustrated in FIG. 10 occur. The occurrence of the orientation irregularities of the pigment 110 results in irregularities of a feeling of metallic luster visually recognized by reflected light from the pigment 110.

Figure 11A:
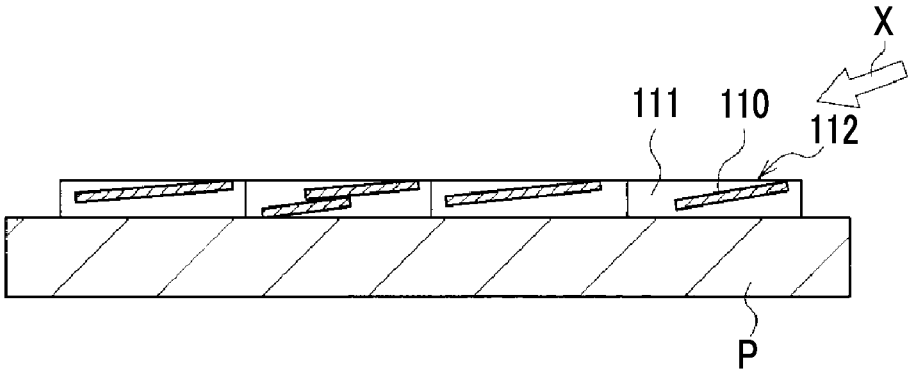
FIG. 11A is a cross-sectional view taken along an arrow A in FIG. 10.
Figure 11B:
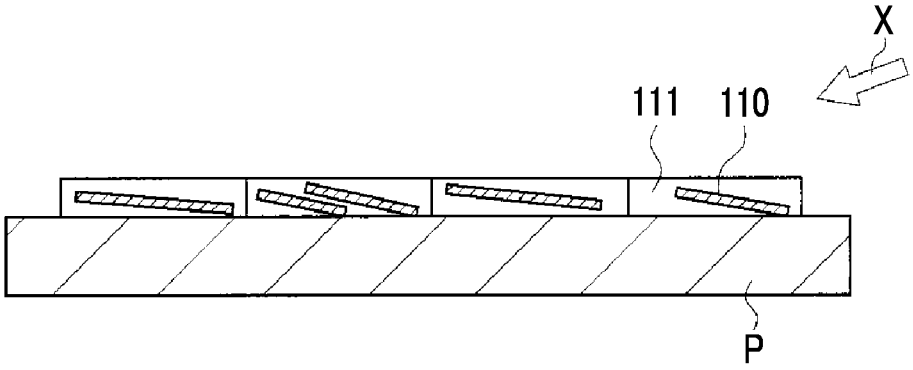
FIG. 11B is a cross-sectional view taken along an arrow B in FIG. 10.

In the example illustrated in FIG. 10, a dark portion PA and a bright portion PB which have a belt shape in a direction intersecting a transport direction D of the recording medium P serve as irregularities that are alternately lined up in the transport direction D. The irregularities are irregularities visually recognized when seen from a direction of an arrow X of FIG. 10. Specifically, as illustrated in FIG. 11A, the dark portion PA has a posture in which the pigment 110 is along a visual recognition direction X, and is set to be in a state where reflected light to the visual recognition side is relatively weak. On the other hand, as illustrated in FIG. 11B, the bright portion PB has a posture in which the pigment 110 faces the visual recognition direction X, and is set to be in a state where reflected light to the visual recognition side is relatively strong. Meanwhile, FIG. 11A is a schematic cross-sectional view taken along the arrow A in FIG. 10, and FIG. 11B is a schematic cross-sectional view taken along an arrow B in FIG. 10.

On the other hand, in the present exemplary embodiment, the frame 70 is pulled in a direction (direction of the arrow B in FIG. 5) in which engagement of the gear 83 with the gear 132 becomes stronger, by the tension mechanism 90. Thereby, a state in which the projecting plate 77 is placed on the cylindrical member 107 (contact state) is maintained. The gear 83 and the gear 132 engage with each other at an engagement position (reference position) which is determined in advance at a position where the projecting plate 77 is placed on the cylindrical member 107.

Thereby, the engagement state between the gear 132 and the gear 83 does not become weaker, and thus the looseness of the gear 132 and the gear 83 is suppressed. Therefore, the vibration of the secondary transfer roller 34 is suppressed, and thus periodic variations in the posture of the pigment 110 are suppressed. That is, in the fixed silver image, orientation irregularities of the pigment 110 are suppressed. Therefore, irregularities of a feeling of metallic luster caused by the orientation irregularities of the pigment 110 are also suppressed, thereby suppressing the formation of a defective image.

In addition, in the tension mechanism 90 of the present exemplary embodiment, the mounting of the frame 70 to the draw-out body 100 leads to a state where the pulling springs 96 pull the frame 70. Therefore, the execution of an operation of accommodating (mounting) the frame 70 in the draw-out body 100 leads to a state where the pulling springs 96 pull the frame 70 even when an operation of attaching the pulling springs 96, or the like is not performed.

In the present exemplary embodiment, since the secondary transfer roller 34 is disposed in the upper portion of the frame 70, the secondary transfer roller 34 is allowed to move around the shaft portion 34A in the upper portion of the frame 70. On the other hand, the pulling springs 96 of the tension mechanism 90 pull the lower portion of the frame 70. For this reason, the arm of the rotational moment centering on the shaft portion 34A becomes longer than in a case where the pulling springs 96 pull the upper portion of the frame 70, and thus a force of the pulling springs 96 pulling the frame 70 may be weak. Therefore, a small-sized spring having a relatively weak tensile force may be used as the pulling spring 96.

Pressing Mechanism 190

In the present exemplary embodiment, the secondary transfer mechanism 39 includes the tension mechanism 90, but may include a pressing mechanism 190 instead of the tension mechanism 90.

Figure 12:
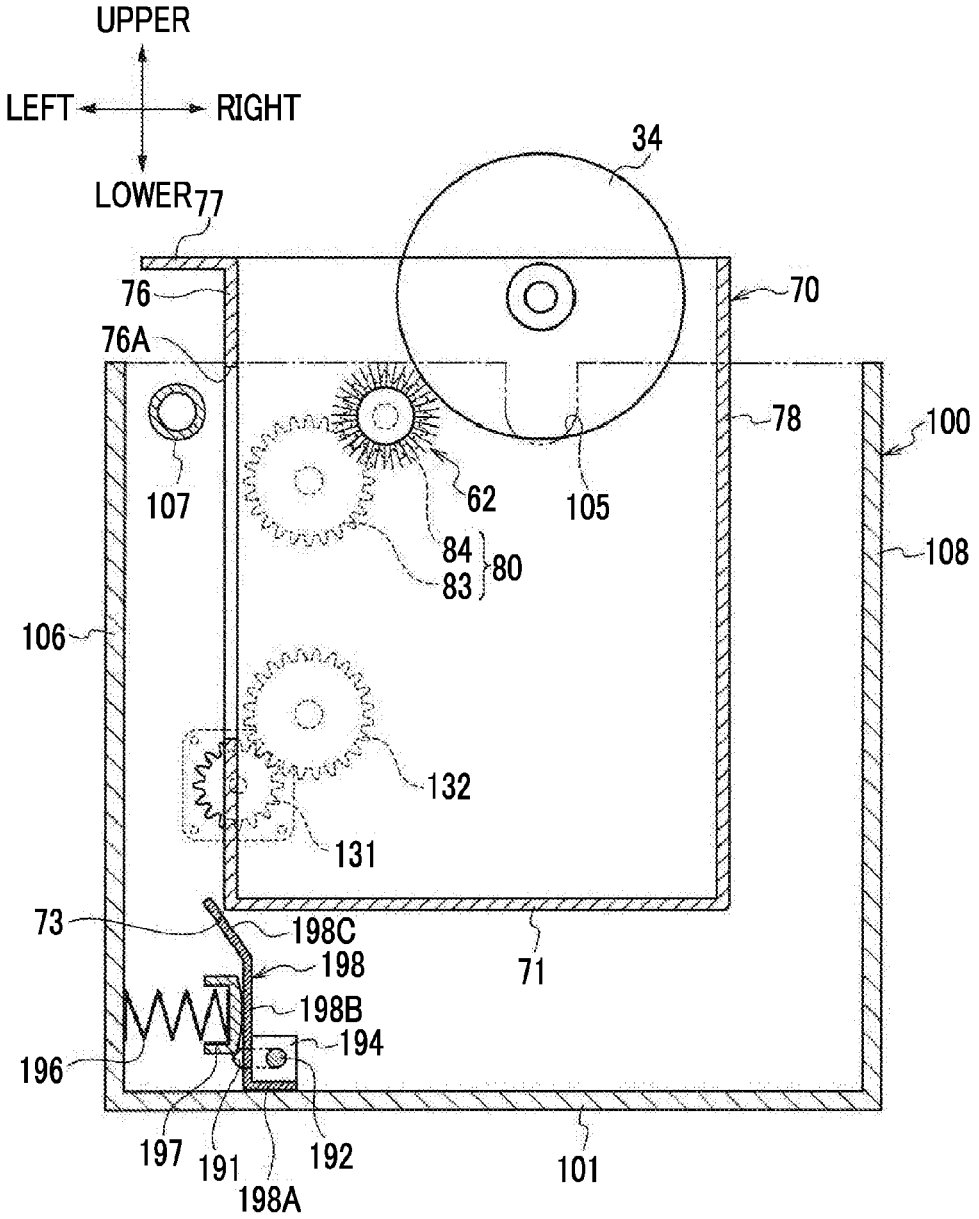
FIG. 12 is a schematic diagram illustrating a configuration of a pressing mechanism according to the present exemplary embodiment.
Figure 13:
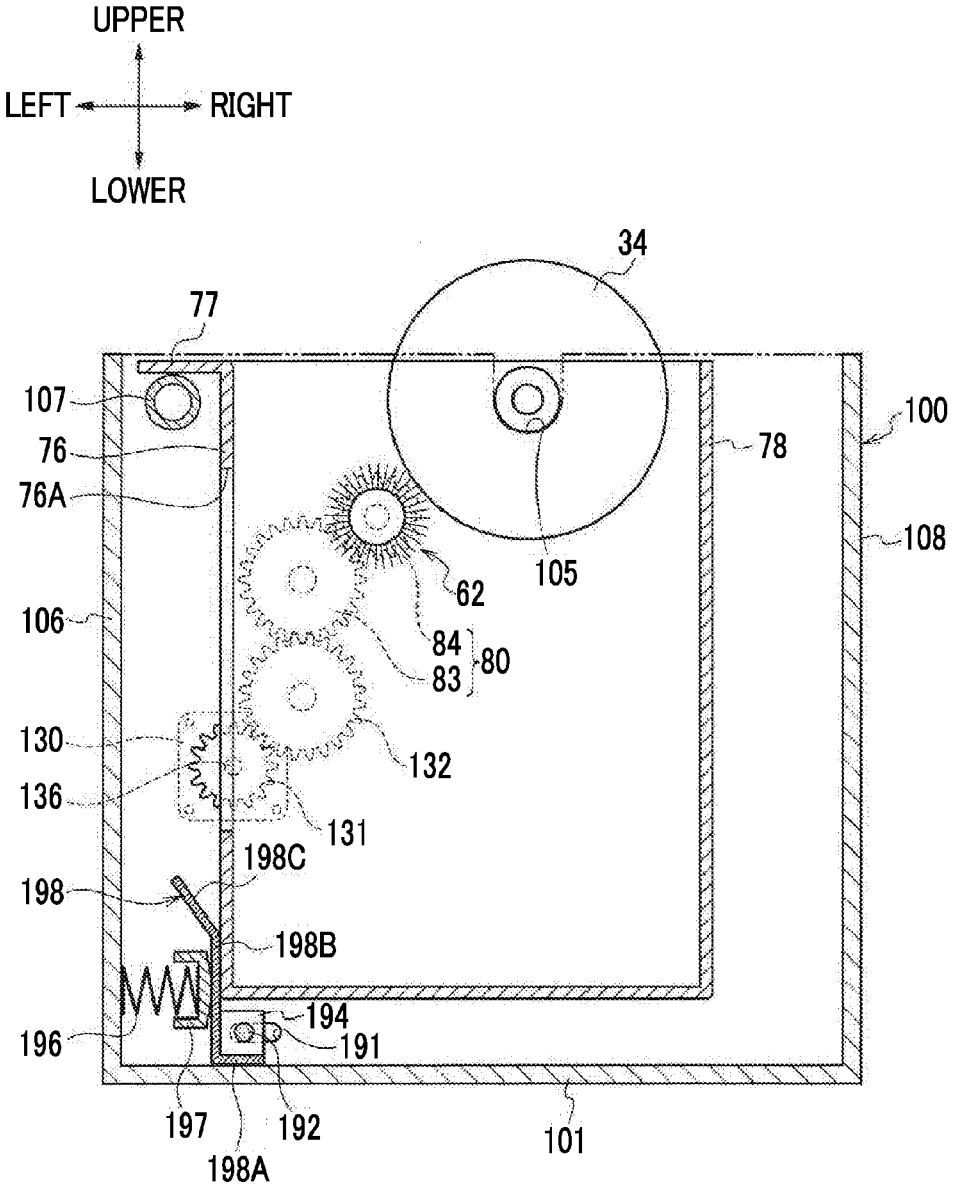
FIG. 13 is a schematic diagram illustrating a configuration of a pressing mechanism according to the present exemplary embodiment.

As illustrated in FIGS. 12 and 13, the pressing mechanism 190 includes a shaft body 192, a fixed plate 194, a compression spring 196 (an example of a member), a mounting member 197, and a receiving plate 198.

The shaft body 192 has a length in the front-back direction, and is supported by the draw-out body 100 so as to be movable in the right-left direction. Specifically, as an example, the shaft body 192 is supported by the draw-out body 100 so as to be movable in the right-left direction by a front end (one end in the longitudinal direction) of the shaft body 192 and a rear end (the other end in the axial direction) thereof being respectively inserted into long holes 191 formed in the front plate 102 and the rear plate 104 along the right-left direction. More specifically, the shaft body 192 is supported by the draw-out body 100 so as to be movable in the right-left direction between a first position (position illustrated in FIG. 12) that comes into contact with a right edge of the long hole 191 and a second position that comes into contact with a left edge of the long hole 191.

As an example, a pair of fixed plates 194 is provided. As an example, the fixed plates 194 are respectively fixed to a rear surface side of the front plate 72 at the front end of the shaft body 192 and a front surface side of the rear plate 74 at the rear end of the shaft body 192.

The receiving plate 198 is fixed to the fixed plate 194. The receiving plate 198 includes a bottom portion 198A fixed to a lower end portion of the fixed plate 194, a receiving portion 198B extending upward from a left end of the bottom portion 198A, and an inclined portion 198C extending to the obliquely upper left side from an upper end of the receiving portion 198B.

Similarly to the fixed plate 194, as an example, a pair of compression springs 196 is provided. The mounting member 197 is mounted to one end (free end) of the compression spring 196, and the other end (fixed end) thereof is attached to the left side plate 106 of the draw-out body 100.

The mounting member 197 is formed to have a cylindrical shape in which the left end side of the mounting member 197 is opened and the right end side thereof is closed. A right end face 197A of the mounting member 197 is formed to protrude rightward. The right end face 197A is in contact with the receiving portion 198B of the receiving plate 198.

Thereby, the compression springs 196 pull the shaft body 192 rightward through the fixed plates 194 by an elastic force. Therefore, in a state where only an elastic force generated by the compression springs 196 acts on the shaft body 192, the shaft body 192 is located at the first position (position illustrated in FIG. 12).

The frame 70 is moved downward with respect to the draw-out body 100 so that the bearing portion 34B of the secondary transfer roller 34 is inserted into the concave portion 105 of the draw-out body 100 by an operator's operation of accommodating the frame 70 in the draw-out body 100, and thus the left side plate 76 of the frame 70 and a corner portion 73 of the bottom plate 71 come into contact with the inclined portion 198C from above. Thereby, the frame 70 moving downward presses the receiving plate 198 rightward through the corner portion 73. In a state where the frame 70 is accommodated in the draw-out body 100, the lower portion of the left side plate 76 of the frame 70 comes into contact with the receiving portion 198B of the receiving plate 198, and the compression springs 196 press the frame 70 rightward through the mounting member 197 and the receiving plate 198. Thereby, the frame 70 is pressed in a direction (direction of the arrow B) in which the engagement of the gear 83 with the gear 132 becomes stronger, around the shaft portion 34A of the secondary transfer roller 34.

In this manner, in the pressing mechanism 190, when the frame 70 is mounted to the draw-out body 100, the corner portion 73 of the frame 70 presses the receiving plate 198 provided at the free end of the compression spring 196 to move the free end, which leads to a state where the compression spring 196 presses the frame 70. That is, in the pressing mechanism 190, the mounting of the frame 70 to the draw-out body 100 leads to a state where the compression springs 196 press the frame 70.

Other Modified Examples

In addition, in the present exemplary embodiment, the secondary transfer roller 34 is used an example of a rotor, but the present invention is not limited thereto. When a secondary transfer belt (an example of a transfer section) is used instead of the secondary transfer roller 34, the secondary transfer belt is wound, and a roller opposite to the opposite roller 32B functions as an example of a rotor.

In addition, in the present exemplary embodiment, the driving motor 130, the driving gear 131, and the gears 132, 83, and 84 are used to rotate the second cleaning brush 62, but the present invention is not limited thereto. The driving motor 130, the driving gear 131, and the gears 132, 83, and 84 may be used to rotate the first cleaning brush 61, the secondary transfer roller 34, other rollers, and the like.

In addition, in the present exemplary embodiment, the image forming unit 20V uses the silver toner 112, but the present invention is not limited thereto. For example, a toner having other metallic color such as gold may be used. A gold toner contains a silver pigment (aluminum or the like) and a yellow pigment. In this manner, a toner containing a flat pigment may contain a pigment other than the flat pigment.

In addition, in the present exemplary embodiment, the frame 70 or a member provided in the frame 70 presses a member provided at the free end of the pulling spring 96 or the compression spring 196 to move the free end by the mounting of the frame 70 to the draw-out body 100, which leads to a state where the frame 70 is pressed or pulled, but the present invention is not limited thereto. For example, a configuration may be adopted in which the mounting of the frame 70 to the draw-out body 100 is detected by a sensor, and the free end of the pulling spring 96 or the compression spring 196 is moved using a driving force by the detection, thereby leading to a state where the frame 70 is pressed or pulled.

In addition, in the present exemplary embodiment, the lower portion of the frame 70 is pressed or pulled, but the present invention is not limited thereto. For example, a configuration may be adopted in which the upper portion of the frame 70, specifically, for example, the projecting plate 77 is pressed or pulled downward.

The present invention is not limited to the above-described exemplary embodiment, and various modifications, changes, and improvements may be made without departing from the scope of the invention. For example, the plural modified examples described above may be appropriately combined with each other.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer mechanism comprising:

a rotor that configures a transfer section which transfers an image including a flat pigment to a recording medium;

a second gear that engages with a first gear provided in a support;

a to-be-supported object that is provided with the rotor and the second gear, is supported by the support through a shaft portion of the rotor, and is allowed to move around the shaft portion in a direction in which engagement of the second gear with the first gear becomes weaker; and a member that presses or pulls the to-be-supported object in a direction in which the engagement becomes stronger.

2. The transfer mechanism according to claim 1, wherein the to-be-supported object is detachably provided on the support, and wherein the member is in a state of pressing or pulling the to-be-supported object by mounting of the to-be-supported object on the support.

3. The transfer mechanism according to claim 2, wherein the rotor is disposed in an upper portion of the to-be-supported object, and wherein the member presses or pulls a lower portion of the to-be-supported object.

4. An image forming apparatus comprising:

a forming section that forms an image including a flat pigment; and the transfer mechanism according to claim 2 which transfers the image formed by the forming section.

5. The transfer mechanism according to claim 1, wherein the rotor is disposed in an upper portion of the to-be-supported object, and wherein the member presses or pulls a lower portion of the to-be-supported object.

6. An image forming apparatus comprising:

a forming section that forms an image including a flat pigment; and the transfer mechanism according to claim 5 which transfers the image formed by the forming section.

7. An image forming apparatus comprising:

a forming section that forms an image including a flat pigment; and the transfer mechanism according to claim 1 which transfers the image formed by the forming section.

8. An image forming apparatus comprising:

a forming section that forms an image including a flat pigment; and the transfer mechanism according to claim 3 which transfers the image formed by the forming section.

* * * * *